United States Patent [19]

Savins et al.

[11] 4,393,934

[45] Jul. 19, 1983

[54] CONDITIONING A COAL SEAM PRIOR TO IN-SITU GASIFICATION

[75] Inventors: Joseph G. Savins; James C. Melrose, both of Dallas, Tex.

[73] Assignee: Mobil Oil Corporation, New York, N.Y.

[21] Appl. No.: 296,039

[22] Filed: Aug. 25, 1981

[51] Int. Cl.[3] ..... E21B 43/24

[52] U.S. Cl. ..... 166/261; 166/256; 299/2; 252/8.55 D

[58] Field of Search ..... 166/261, 256, 259; 252/8.55 D; 299/2; 48/DIG. 6, 210

[56] References Cited

U.S. PATENT DOCUMENTS

| | | | |
|---|---|---|---|
| 3,032,103 | 5/1962 | Parker | 166/256 |
| 4,015,663 | 4/1977 | Strubhar | 166/259 X |
| 4,026,357 | 5/1977 | Redford | 166/261 |
| 4,087,130 | 5/1978 | Garrett | 299/2 |
| 4,114,688 | 9/1978 | Terry | 166/261 X |
| 4,197,911 | 4/1980 | Anada | 48/DIG. 6 X |
| 4,303,127 | 12/1981 | Freel et al. | 48/DIG. 6 X |
| 4,313,499 | 2/1982 | Tsai et al. | 48/DIG. 6 X |

OTHER PUBLICATIONS

"Applications of Reservoir Simulation to In Situ Coal Gasification," Mar. 1980, Department of Energy Contract No. DE-AC04-76DP00789, R. E. Glass.

"Permeability Characteristics of Coal Seam," Proceedings of the Third Annual Underground Coal Conversion Symposium, Fallen Leaf Lake, Calif., Jun. 6-9, 1977, pp. 454-465, Lien et al.

"Underground Therma Generation of Hydrocarbons from Dry, Southwestern Coals," Proceedings of the 13th Intersociety Energy Conversion Engineering Conference, Aug. 20-25, 1978, pp. 366-372, San Diego, Calif., Vanderborgh et al.

"The Measurement of the Flow Properties of Coals for In-Situ Gasification," Jan. 1979, University of Pittsburgh, Prepared for Department of Energy under Contract No. ET 78-S-O-Z4639, Reznik et al.

*Primary Examiner*—Ernest R. Purser
*Assistant Examiner*—Thuy M. Bui
*Attorney, Agent, or Firm*—Charles A. Huggett; James F. Powers, Jr.; Lawrence O. Miller

[57] ABSTRACT

A method for conditioning a coal seam prior to in-situ gasification to increase the permeability of the coal seam to the flow of combustion-supporting gas therethrough and thus increase the efficiency of gasification wherein a wettability alteration fluid is injected into the coal seam via an injection well and fluids including the wettability alteration fluid are recovered from a spaced apart production well. Injection of the wettability alteration fluid is continued into the coal seam until the permeability thereof to the flow of the combustion-supporting gas therethrough has increased to a maximum extent. Suitable wettability alteration fluids include carbon dioxide, volatile amines, aqueous solutions containing phosphates, phenols, flue gas and alcohols, and mixtures thereof.

10 Claims, 1 Drawing Figure

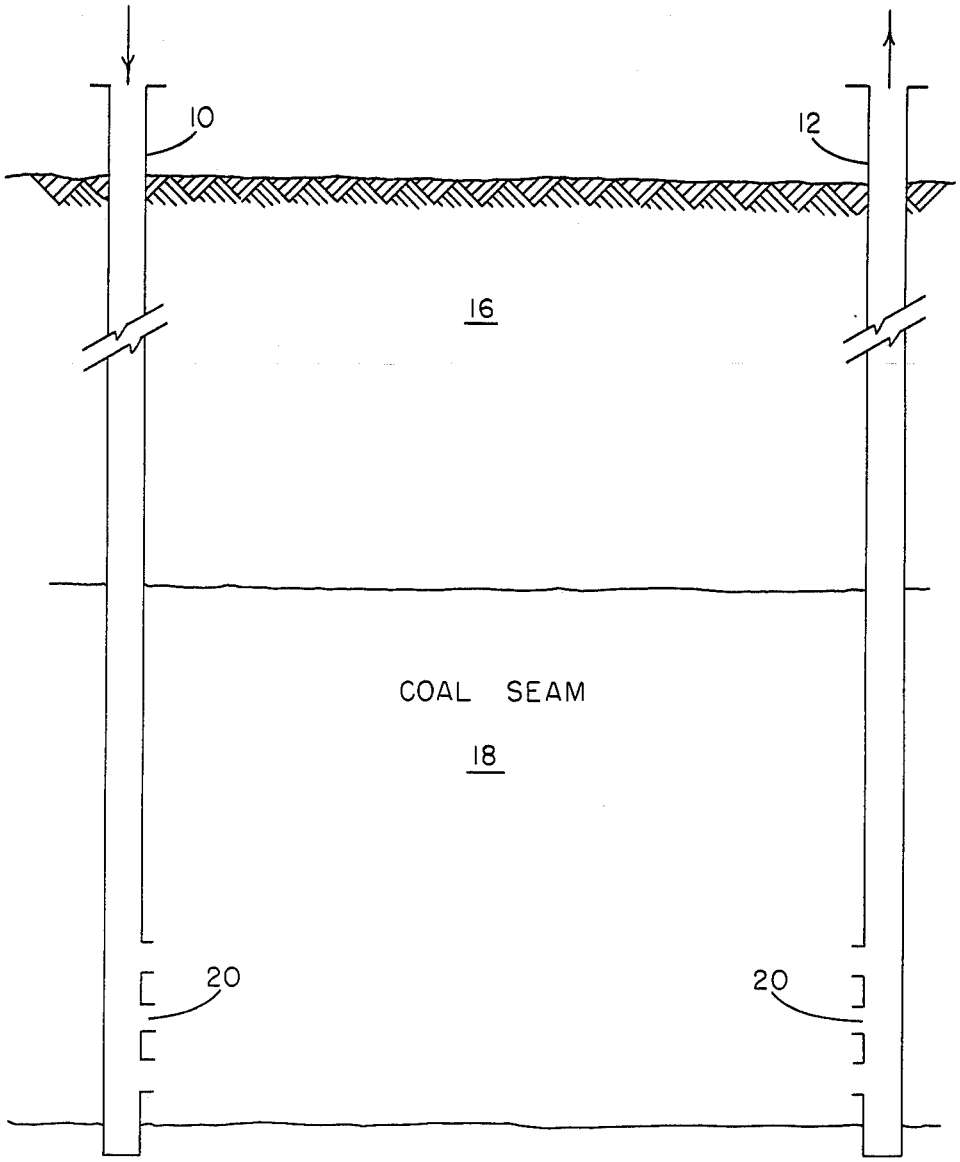
10
12
16
COAL SEAM
18
20
20

CONDITIONING A COAL SEAM PRIOR TO IN-SITU GASIFICATION

BACKGROUND OF THE INVENTION

1. Field of the Invention

This invention relates to a method for conditioning a coal seam prior to underground coal gasification wherein the permeability of the coal seam to gases has been substantially increased.

2. Description of the Prior Art

In developing the underground coal gasification (UCG) process wherein a combustion front is moved from an injection well to a production well, it is first necessary to establish a high gas permeability zone between these wells prior to ignition of the coal with an oxygen-containing gas, otherwise combustion cannot be carried out efficiently. To establish the high gas permeability zone, a number of methods have been employed such as fracturing the coal seam with explosives, pneumatic and hydraulic fracturing, directional drilling, and reverse combustion linking. Such methods, however, have inherent limitations. For example, fracturing the coal seam is not very successful because it frequently happens that fracturing takes place beyond the boundaries of the coal seam. Water can then leak into the seam from an overlying aquifer and injected combustion-supporting gas and product can be lost through the overburden. Moreover, fracturing may not be evenly distributed throughout the seam, leading to under-utilization of the coal during gasification. Also, it is necessary to shut down the operation when it is desired to start combustion in a new portion of the seam. This makes for frequent cessation of operation and increase in cost. In the case of the reverse combustion linking process, a combustion-supporting gas such as air is injected at high pressure and low volume in one process well and the coal is ignited in the other process well. The thermal front is then drawn toward the air source leaving a highly permeable char zone. It can be seen, however, that the reverse combustion linking process may fail to work if there are insufficient air flow paths to enable the combustion-supporting gas to pass through the coal seam and establish the link along the bottom of the seam.

As an alternative approach to the problem of increasing the permeability to gas in a coal seam, it appears that a method designed to (1) reduce the water content of the coal, and (2) alter the wettability of the coal, would be highly beneficial. This is because, in the first instance, the removal of water from coal per se results in an increase of permeability for the flow of gases. The relation between the relative permeability of a water-containing coal seam to gas as a function of water content or saturation is shown in FIG. 3 on page 8, in a paper by R. E. Glass entitled, "Applications of Reservoir Simulation to In Situ Coal Gasification," March 1981, Department of Energy Contract No. DE-AC04-76DP00789. These results clearly show that the relative permeability of a coal seam to gas increases as the water saturation decreases.

Another article by Lien et al., "Permeability Characteristics of Coal Seam," Proceedings of the Third Annual Underground Coal Conversion Symposium, Fallen Leaf Lake, California, June 6–9, 1977, pp. 454–465, shows the relation between the relative permeabilities to gas as a function of water saturation for various ranks of coal.

As is evident then, it would be largely desirable to condition a coal seam so as to increase gas phase permeability of a coal seam prior to in-situ gasification so as to increase the efficiency of the UCG process. As indicated, gas permeability rises rapidly as water is removed from a coal seam.

The benefits of a reduced water content will be further enhanced, to a significant degree, if the wettability of the coal is altered. This is because wettability is an important factor in determining the dependence of gas relative permeability on water saturation. Thus, very low rank coals are normally highly water-wet and have a low gas permeability in the intermediate range of water saturations. Higher rank coals (in the range of 90 percent carbon) are significantly less water-wet and have considerably higher gas permeabilities for intermediate water saturations. It follows, thus, that altering the wettability of a very low rank coal in such a way that the coal is less water-wet will greatly increase the gas permeability of the coal.

The increase in gas permeability may therefore be accomplished both directly, as a consequence of the increase in gas relative permeability for a given water saturation, and indirectly, since for a given gas phase driving pressure the water saturation is more effectively decreased as the result of the flow of gas. A further benefit results from the increase in the water phase relative permeability which occurs when the coal becomes somewhat less water-wet. An increase in water phase relative permeability also enhances the removal of water from the coal and thereby contributes to the increase in gas permeability.

SUMMARY OF THE INVENTION

This invention is a method for reducing the water saturation of coal in a subsurface coal seam without chemical comminution and also altering its wettability so as to significantly increase the gas permeability of the coal seam to an optimum level prior to in-situ gasification. A wettability alteration fluid is injected into the coal seam via an injection well and fluids including the wettability alteration fluid are recovered from the coal seam via a spaced apart production well. Sufficient wettability alteration fluid is injected into the coal seam until the permeability of the coal seam to the combustion-supporting gas used for gasification increases to the maximum level permitted by the pore structure of the coal. Conditioning the coal seam by this process increases the gas permeability of the coal between the injection well and the production well, thereby decreasing the resistance of the seam to the flow of an injected combustion-supporting gas used for in-situ gasification of the seam. The wettability alteration fluid includes carbon dioxide, volatile amines, phosphates, phenols, flue gas and alcohols that do not substantially comminute the coal being treated, and mixtures thereof.

BRIEF DESCRIPTION OF THE DRAWING

The drawing illustrates in cross-sectional view, a pair of wells penetrating a coal seam arranged for operation of the invention.

DETAILED DESCRIPTION OF THE INVENTION

The present invention involves a method for conditioning a water-containing subsurface coal seam penetrated by at least one injection well and one spaced apart production well prior to in-situ gasification so that the coal seam is more permeable to the combustion-supporting gases used for coal gasification, thereby greatly improving the efficiency of the gasification process. Referring to the drawing, an injection well 10 and a production well 12 penetrate from the surface of the earth through over-burden 16 into a coal seam 18. Wells 10 and 12 have perforations 20, preferably in the bottom portion thereof, to provide fluid communication with a portion of the vertical thickness of the coal seam 18. In-situ gasification is conducted by injecting a combustion-supporting gas such as oxygen, air, or oxygen-enriched air into the coal seam through injection well 10. The lower portion of the coal seam is ignited and in-situ gasification begins using a method such as taught in the article by Vanderborgh et al., "Underground Thermal Generation of Hydrocarbons from Dry, Southwestern Coals," Proceedings of the 13th Intersociety Energy Conversion Engineering Conference, August 20–25, 1978, pp. 366–372, San Diego, Calif., which is incorporated herein by reference. The products of combustion are removed from production well 12.

Prior to in-situ gasification, a wettability alteration fluid is injected into the coal seam 18 via the injection well 10. The wettability alteration fluid migrates through the coal seam 18 toward production well 12 where fluids including the wettability alteration fluid are recovered from the production well. The wettability alteration fluid facilitates the reduction of the water saturation of the coal without chemical comminution and also alters the wettability of the coal thereby increasing its gas permeability. Sufficient wettability alteration fluid is injected into the coal seam until the permeability of the coal seam to the combustion-supporting gas used for gasification increases to the maximum level permitted by the pore structure of the coal. The amount of fluid injected will depend upon the moisture content of the coal, the rank of the coal, the thickness of the coal seam and the distance between the injection and production wells.

The relative permeabilities to gas as functions of water saturation vary for different ranks of coal. Also, depending on the rank of coal, the permeability may vary for different gases. The relative permeability (Krg) of a high rank Princetown coal to nitrogen and carbon dioxide as a function of water saturation (Sw) is shown in FIG. 11 (page 36) of a paper by Reznik et al., "The Measurement of the Flow Properties of Coals for In-Situ Gasification," January, 1979, University of Pittsburgh, Prepared for Department of Energy under Contract No. ET 78-S-O-Z-4639, which is incorporated herein by reference. The value of the effective permeability to gas, kg, at $Sw=0$ is termed the absolute permeability to gas. In accordance with normal petroleum engineering convention, the relative permeability to gas is defined as the ratio of the effective permeability to gas to the absolute permeability to gas. The relative permeability to gas, Krg, has values ranging from 0 to 1. These results show that as the water saturation level of the coal is initially decreased, there is an extremely rapid increase in permeability. For example, a decrease in water saturation from only 1.0 to 0.7 increases permeability to carbon dioxide about 90%. Further decreases in water saturation only result in a modest increase in permeability. This behavior is similar for a number of coals investigated by Reznik et al. Therefore, in such cases dewatering the coal until the gas permeability has increased an amount of about 90% constitutes the optimum level.

Once the permeability increase is obtained, based upon the oxygen-containing gas being used for in-situ gasification, injection of the wettability alteration fluid is terminated. The coal seam having increased gas permeability is then subjected to a conventional underground coal gasification process as previously described.

Suitable wettability alteration fluids include carbon dioxide, volatile amines such as propylamine, ethanolamine and methylamine, aqueous solutions containing water-soluble phosphates such as ammonium phosphates, phenols, flue gas and alcohols such as methanol, ethanol and propanol and mixtures thereof. In the case of alcohols, it has been found that methanol comminutes a high rank (bituminous) coal: Herrin: Illinois No. 6 but does not comminute a low rank (sub-bituminous) coal: Tipperary: Ucross. Therefore, methanol would be a suitable wettability alteration fluid for a low rank coal but not for a high rank coal. The preferred wettability alteration fluid is carbon dioxide.

We claim:

1. A method for conditioning a subsurface wet coal seam prior to in-situ gasification wherein combustion of a portion of the coal in said seam has been initiated and is maintained by injection of a combustion-supporting gas into said seam through an injection well whereby there results an in-situ combustion front containing hot combustion gases which move toward a spaced production well and movement of this front displaces the hot combustion gases into the production well for recovery, the improvement comprising injecting into said coal seam via said injection well a wettability alteration fluid, said wettability alteration fluid capable of decreasing the water content of said coal and altering the wettability of said coal thereby increasing the permeability thereof to the flow of gas therethrough; recovering fluids including the wettability alteration fluid from said coal seam via said production well, and continuing to inject said wettability alteration fluid into said coal seam until the permeability thereof to the flow of said combustion-supporting gas therethrough has increased to a maximum extent.

2. A method as defined in claim 1, wherein said wettability alteration fluid is a member of the group consisting of carbon dioxide, volatile amines, aqueous solutions containing phosphates, phenols, flue gas and alcohols, and combinations thereof.

3. A method as defined in claim 2 wherein said member of said group is carbon dioxide.

4. A method as defined in claim 2 wherein said member of said group is propylamine.

5. A method as defined in claim 2 wherein said member of said group is ethanolamine.

6. A method as defined in claim 2 wherein said member of said group is methylamine.

7. A method as defined in claim 2 wherein said member of said group is an aqueous solution containing ammonium phosphate.

8. A method as defined in claim 2 wherein said member of said group is methanol.

9. A method as defined in claim 2 wherein said member of said group is an ethanol.

10. A method as defined in claim 2 wherein said member of said group is propanol.

* * * * *